US006432229B1

(12) United States Patent
Asai et al.

(10) Patent No.: US 6,432,229 B1
(45) Date of Patent: Aug. 13, 2002

(54) METHOD AND APPARATUS FOR MONITORING WORK HEATING TEMPERATURE IN FLAME HARDENING

(75) Inventors: Katsuhiko Asai; Kazuo Shirai, both of Aichi (JP)

(73) Assignee: Sanyo Machine Works, Ltd., Nishikasugai-gun (JP)

( * ) Notice: Subject to any disclaimer, the term of this patent is extended or adjusted under 35 U.S.C. 154(b) by 0 days.

(21) Appl. No.: 09/581,557

(22) PCT Filed: Dec. 2, 1998

(86) PCT No.: PCT/JP98/05425

§ 371 (c)(1),
(2), (4) Date: Aug. 31, 2000

(87) PCT Pub. No.: WO00/32827

PCT Pub. Date: Jun. 8, 2000

(51) Int. Cl.[7] ..... C21D 1/54
(52) U.S. Cl. ..... 148/511; 266/87
(58) Field of Search ..... 148/508, 511; 266/87, 48

(56) References Cited

U.S. PATENT DOCUMENTS 4,872,926 A * 10/1989 Giacobbe ..... 148/511
5,238,509 A * 8/1993 Kusunoki ..... 148/511
5,606,796 A * 3/1997 Fraser ..... 29/889.1

* cited by examiner

*Primary Examiner*—Scott Kastler
(74) *Attorney, Agent, or Firm*—Arent Fox Kintner Plotkin & Kahn

(57) ABSTRACT

Temperature in the vicinity of a heated point on a work (1) surface on a moving locus of flame poured from a torch (3) is measured, the measured value is inputted into a controlling unit (8). It is converted into a physical quantity which appeals to the perception of a worker, such as light, sound, or vibration, and outputted to warning means (5, 9, and 10). The measured value is compared with a predetermined standard temperature range, and as the measured value approaches the upper limit or the lower limit of the standard temperature range, the physical quantity produced as warning signal is stepwise changed. This permits the worker to perceive the change in the measured value, and to easily change the position of the torch or the moving speed thereof so that the temperature at the heated point is maintained within the standard temperature range. Also, recording the measured values of the heating temperatures by connecting a recording unit (11 and 12) to the controlling unit (8), can serve to quality control.

11 Claims, 2 Drawing Sheets

METHOD AND APPARATUS FOR MONITORING WORK HEATING TEMPERATURE IN FLAME HARDENING

BACKGROUND ART

The present invention relates to monitoring or control of work heating temperature in flame hardening, and more particularly to a method making it possible for workers to control positions and moving speed of a torch so that the work heating temperature can be maintained within a predetermined temperature range, by notifying the workers of the change in the work hating temperature.

Flame hardening is a kind of surface hardening method. Flame hardening is performed by introducing a mixture of fuel gas and oxygen at an increased flow rate into a torch, combusting this mixture gas at the nozzle tip of the torch, and rapidly heating the surface layer of a work with a high-temperature flame obtained by the combustion. In flame hardening, heating speed is high and the temperature distribution in a work depicts a gentle curve, so that, in order to achieve an intended hardening temperature at a predetermined depth, the surface temperature of the work needs to be raised considerably high. Because this temperature gradient occurs due to the heat transfer by the heat conduction phenomenon, the measurement of the surface temperature of a work plays an important role. Since the measurement with a thermometer and the setting thereof are difficult because of the high heating speed, the temperature judgment by a visual observation is essential.

Conventionally, for example, the flame hardening of the cutting edge part of die used for press-molding automobile parts has relied on empirical work by the visual observation of skilled workers. However, in recent years, because of the improvement of the quality of products and the shortage of skill workers, the conventional method which has quite relied on skill is raising a problem. That is, in order to improve the quality of products, it is necessary to eliminate variations in the flame hardening hardness to maintain homogeneous cutting edge hardness characteristics, and further to leave the results obtained, as quality data. However, since the flame hardening has been performed in such a manner that a worker moves the torch while observing the color of the steel material of a flame-hardened member, wide variations have occurred in the results depending on personal properties or lighting conditions in the surroundings. Furthermore, since the heating temperature on a work surface cannot be left as calculative data, it has been pointed out that a problem arises in that, when customer-complaint due to poor flame hardening takes place after a product has been shipped, it is impossible to trace and investigate the cause of the poor flame hardening.

DISCLOSURE OF THE INVENTION

In accordance with the method for monitoring a work heating temperature in flame hardening of the present invention, the temperature of the work surface heated by flame poured from the torch for use in flame hardening is measured; the measured value is converted into a physical quantity which appeals to the perception of a worker; the measured value is compared with a predetermined standard temperature range; and a warning signal is produced when the measured value approaches the upper limit or the lower limit of the standard temperature range.

Even this allows a worker to obtain a work environment different from the conventional one, and to work much more easily. In addition, the present invention aims at a further improvement in the accuracy and a superior workability, and arranges the intensity of the aforesaid warning signal so as to be changed in response to the change in the measured value. Specifically, the present invention stepwise changes the intensity of a warning signal as the measured value approaches the upper limit or the lower limit of the standard temperature range.

A worker, therefore, receives feedback, before the upper limit or the lower limit of the standard temperature range has been reached, on the information that the upper limit or the lower limit is being approached, and that it is going to be soon reached. As a result, the work heating temperature can be always maintained at the predetermined standard temperature range. This permits the prevention of the occurrence of defective articles due to an excess, a shortage, or variations of the flame hardening temperature, which leads to the achievement of an improvement in the quality of product. Also, this permits even an unskilled worker to perform a high-accuracy flame hardening operation, which results in a significant effect on the rationalization and the labor-saving in the flame hardening process.

Recording measured values with recording means allows to work results of flame hardening to be outputted in the form of temperature graphs or numeral value lists, which also serves to the improvement in quality control function. Furthermore, recording measured values allows the changes in the flame hardening temperature with time to be left as records, which facilitates process management and the tracing and investigation of the cause of the occurrence of defective articles.

The apparatus for monitoring a work heating temperature in flame hardening in accordance with the present invention comprises a torch for use in flame hardening; a temperature sensor for measuring the temperature in the vicinity of the heated point on the work surface on the moving locus of the flame poured from the torch; controlling means connected to said temperature sensor, for comparing the measured value of temperature with a predetermined standard temperature range, and producing a warning signal when the measured value approaches the upper limit or the lower limit of the standard temperature range; and warning means operating in response to the signal from the aforesaid controlling means.

The aforesaid controlling means sends a warning signal to the warning means before the measured value reaches the upper limit or the lower limit of the standard temperature range, and changes the outputs of the warning means in response to the change in the aforesaid measured value. Also, the controlling means is arranged so that a physical quantity which appeals to the perception of a worker occurs by the operation of the warning means, and that the aforesaid physical quantity is stepwise changed as the measured value approaches the upper limit or the lower limit of the standard temperature range.

As a temperature sensor, various types of non-contact temperature sensors may be used. One example among them is an infrared temperature sensor. In this case, a sensor head is installed at a part of the torch, and connected to the controlling means via a flexible optical fiber.

In order to record a measured value, recording means is connected to the aforesaid controlling means. As recording means, magnetic recording means such as tape, card, or disk can be used, beside a pen recorder or a printer used to record the measured value on paper.

Hereinbelow, embodiments of the present invention will be explained with reference to the accompanying drawings.

BEST MODE FOR CARRYING OUT THE INVENTION

Figure 1:
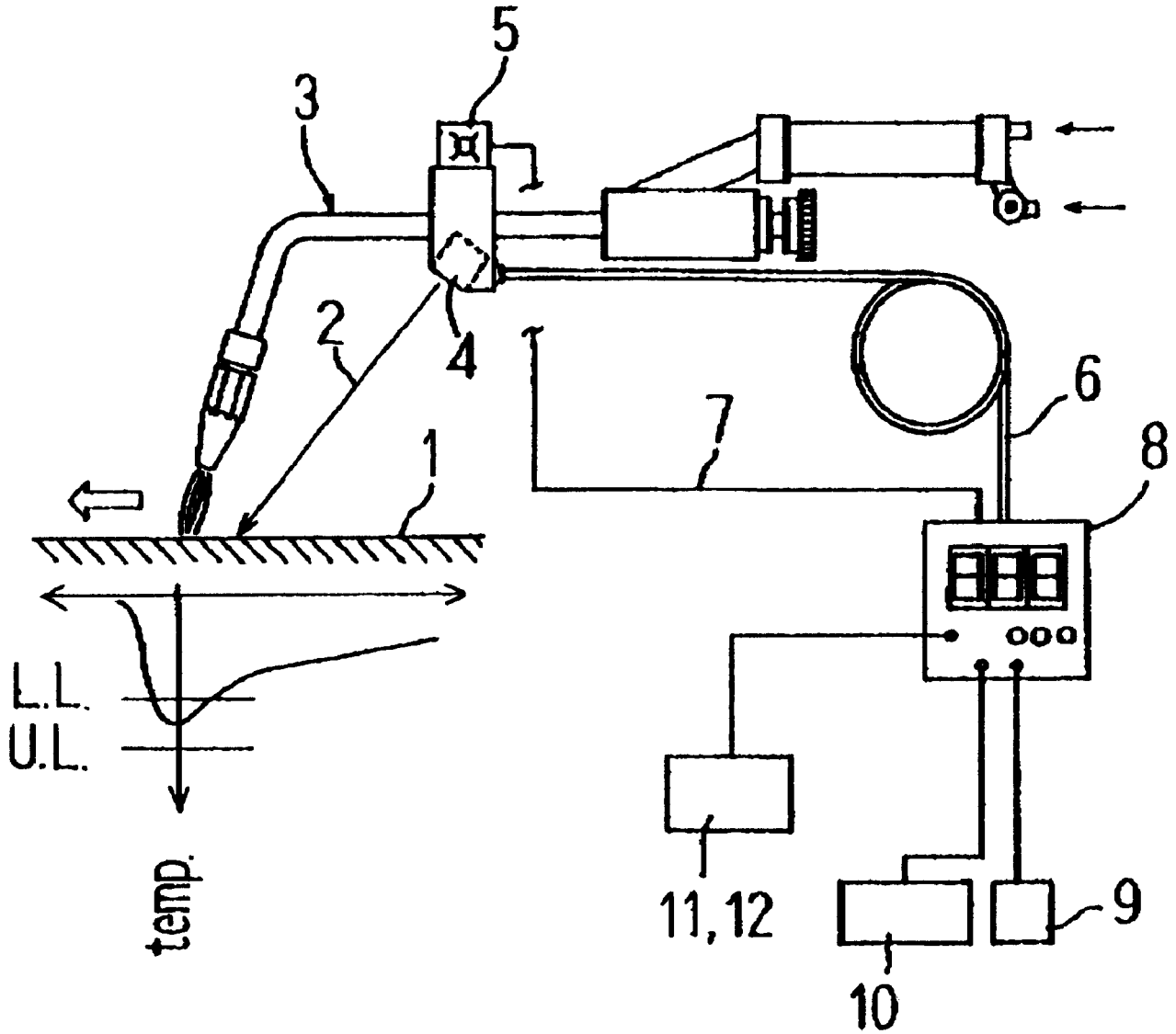
FIG. 1 is a block diagram showing the work heating temperature controlling unit of the present invention.

As shown in FIG. 1, a flame hardening apparatus (30) is mainly composed of a torch (3), a temperature sensor including a sensor head (4), a controlling unit (8), and warning means (5, 9, and 10).

The torch (3) is used for a worker to perform flame hardening work while holding it by hands, and is constituted so as to pour flame from the nozzle tip thereof, as shown in the drawing, using a mixture gas of, for example, oxygen and acetylene as a fuel gas. The sensor head (4) of the temperature sensor is installed at a part of the torch (3) directly or via a bracket. As the temperature sensor, a non-contact type temperature sensor, for example, an infrared temperature sensor may be adopted. The infrared temperature sensor takes in infrared rays from the sensor head (4) into the controlling unit (8) via a flexible optical fiber (6) formed of quartz fiber or another, and measures temperature on the basis of the wavelength of the infrared rays. Represented by reference numeral 2 in FIG. 1 is red LED light which is emitted to identify a temperature measurement position on the work (1) surface. By referring to the spot of the LED light, the installation position or the posture of the sensor head (4) is adjusted. In general, when performing flame hardening while moving the flame from right side to left side in FIG. 1, it is preferable that the installation position or the posture of the sensor head (4) be set so that the temperature at the point slightly back of flame on the work (1) surface is measured.

Figure 2:
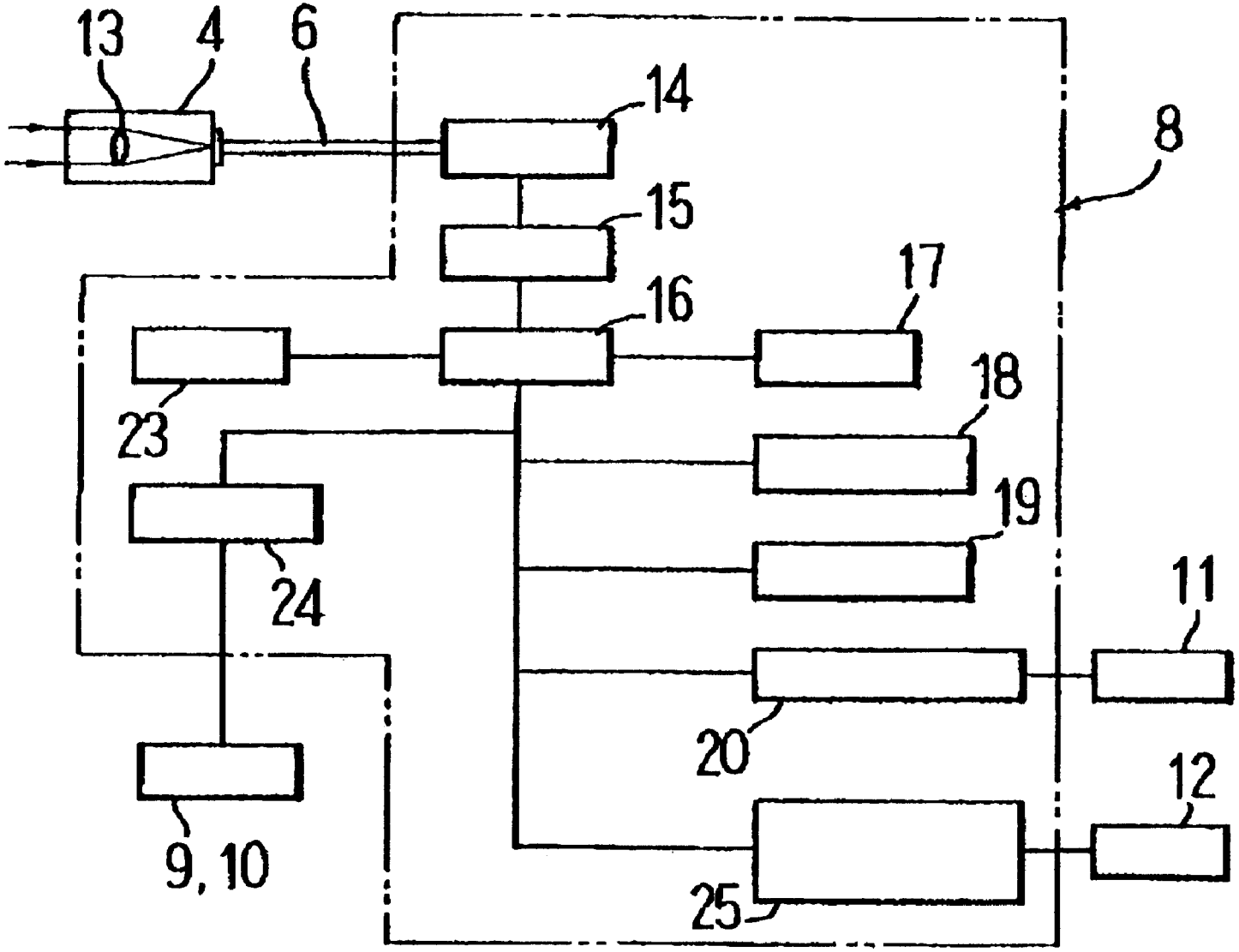
FIG. 2 a block diagram showing the temperature monitoring apparatus of the present invention.

In FIG. 2, there is shown the details of the controlling unit (8). The sensor head (4) is connected with a photoelectric transduction part (14) of the controlling unit (8) via an optical fiber (6). The infrared rays gathered by a condenser (13) of the sensor head (4) are sent to the photoelectric transduction part (14) via the optical fiber (6), and converted into electric signals. The electric signals are transmitted to a CPU or a signal processing part (16) via an A/D converter (15).

The signal processing part (16) includes a temperature displaying part (17) for displaying a measured value of temperature in digital and/or analog forms, and setting displaying part (23) for displaying set values (the upper limit value and the lower limit value). Also, the signal processing part has an upper limit temperature judging beeper (18) and a lower limit temperature judging beeper (19) each of which compares the measured value with the set value of each and issues a warning when the measured value reaches the set value of each. Moreover, a temperature analog outputting part (20) connected with a pen-recorder (11), and a temperature data printout part (25) connected with a printer (12) are provided, whereby the signal processing part concurrently monitors and records the measured values in succession.

To the signal processing part (16), also a conversion part (24) for converting temperature into another physical quantity is connected. The conversion part (24) converts the work surface temperature detected by the sensor head (4) into another physical quantity, and provides the output to the warning means in response to this physical quantity. By stepwise changing the output of the warning means as the measured value of the surface temperature of work (1) approaches the set value (the upper limit value or the lower limit value), a worker can perceive before the surface temperature has reached the upper or lower limit value, that the surface temperature is going to soon reach the set value. Furthermore, since the output of the warning means is stepwise changed as the set value of the surface temperature is approached, the worker can easily grasp the relationship between the current temperature of the work surface and the set value. It is therefore possible to perform flame hardening operation within an optimum temperature range by delicately changing the distance between the torch (3) and the work (1).

As an output signal of the warning means, or a signal for notifying a worker of the change in the measured temperature, any one of physical quantities which appeal to the perception of a worker, such as sound, light, vibration, and others can be optionally selected and utilized, or some of these physical quantities can be utilized in combination. In the case of sound, fore example, a earphone or speaker (9) is provided, and the sound level or the sound quality is changed in response to the change in measured temperature. In the case of light, the torch (3) is provided with a lamp (5), and the lamp is changed in the amount of light or the frequency of blink in response to the change in measured temperature. In the case of vibration, a worker is made to carry a vibrator (10), and the amplitude or the frequency of vibration thereof is changed in response to the change in measured temperature.

Even if any of the above-described warning means is adopted, the warning means start to issue a warning signal when the measured value of the surface temperature of the work (1) heated by the torch (3) approaches the upper limit or the lower limit of the predetermined temperature range, and the warning signal is stepwise changed as the measured value approaches the upper limit or the lower limit. Taking the case of sound as an example, the sound level is increased as the upper limit or the lower limit is approached. Therefore, a worker changes the distance between the torch (3) and the work (1) and adjusts the moving speed of the torch (3) and the amount of flame poured per unit hour, thereby the surface heating temperature of work (1) is maintained within a predetermined temperature range. In FIG. 1, there is shown a temperature distribution curve of which the horizontal axis represents the distance from a heated point, and of which the vertical axis represents the temperature of a work surface. In this graph, L.L. and U.L. denote the lower limit and the upper limit of the predetermined temperature range, respectively.

What is claimed is:

1. A method for monitoring a work heating temperature in flame hardening a work, said method comprising the steps of:

measuring the temperature of a surface of the work heated by flame poured from a torch manually manipulated by a worker for use in flame hardening;

converting a measured value into a physical quantity capable of being sensed by the worker;

comparing the measured value with a predetermined standard temperature range; and producing a warning signal when the measured value approximates either an upper limit or a lower limit of the standard temperature range.

2. A method for monitoring a work heating temperature in flame hardening according to claim 1, wherein an intensity of the warning signal either increases or decreases in response to the change in the measured value.

3. A method for monitoring a work heating temperature in flame hardening according to claim 2, wherein the intensity of the warning signal is stepwise changed as the measured value approaches the upper limit or the lower limit of the standard temperature range.

4. A method for monitoring a work heating temperature in flame hardening according to claim 1, wherein the measured value is recorded by recording means.

5. An apparatus for monitoring a work heating temperature in flame hardening a work, comprising:

a torch manually manipulable by a worker for use in flame hardening;

a temperature sensor for measuring the temperature in a vicinity of a heated point on a surface of the work on a moving locus of flame poured from the torch;

controlling means connected to said temperature sensor, for comparing a measured value of said temperatures with a predetermined standard temperature range, and producing a warning signal when the measured value approximates either an upper limit or a lower limit of the standard temperature range; and warning means operating in response to the signal from said controlling means.

6. An apparatus for monitoring a work heating temperature in flame hardening according to claim 5, wherein said controlling means sends a signal to the warning means before the measured value reaches the upper limit or the lower limit of the standard temperature range, and changes the output of the warning means in response to the change in the measured value.

7. An apparatus for monitoring a work heating temperature in flame hardening according to claim 6, wherein a physical quantity capable of being sensed by a worked occurs by the operation of said warning means; and said physical quantity is stepwise changed as the measured value approaches the upper limit or the lower limit of the standard temperature range.

8. An apparatus for monitoring a work heating temperature in flame hardening according to claim 5, wherein said temperature sensor is an infrared temperature sensor having connected with said controlling means via an optical fiber, said temperature sensor having a sensor head thereof installed as a part of the torch.

9. An apparatus for monitoring a work heating temperature in flame hardening according to claim 5, wherein recording means for recording the measured value is connected to said controlling means.

10. A method of monitoring a work heating temperature in flame hardening according to claim 1, further comprising the step of:

measuring the temperature in a vicinity of a heated point on a surface of the work on a moving locus of flame poured from the torch.

11. An apparatus for monitoring a work heating temperature in flame hardening according to claim 5, wherein the temperature sensor is connected to the torch.

* * * * *